US008746540B2

(12) United States Patent
Hultberg et al.

(10) Patent No.: US 8,746,540 B2
(45) Date of Patent: Jun. 10, 2014

(54) CHILD RESISTANT BOX FOR OBJECTS

(75) Inventors: Lennart Hultberg, Åstrop (SE); Lars Sonesson, Ramlösa (SE)

(73) Assignee: McNeil AB, Helsingborg (SE)

( * ) Notice: Subject to any disclaimer, the term of this patent is extended or adjusted under 35 U.S.C. 154(b) by 517 days.

(21) Appl. No.: 12/917,896

(22) Filed: Nov. 2, 2010

(65) Prior Publication Data

US 2012/0097735 A1 Apr. 26, 2012

(30) Foreign Application Priority Data

Oct. 22, 2010 (SE) ..... 1001039

(51) Int. Cl.
*B65D 5/54* (2006.01)
*B65D 5/02* (2006.01)

(52) U.S. Cl.
CPC ..... *B65D 5/0227* (2013.01); *B65D 5/5405* (2013.01); *Y10S 206/807* (2013.01)
USPC ..... 229/102; 229/136; 206/807

(58) Field of Classification Search
CPC ..... B65D 5/5405; B65D 5/541; B65D 5/0227
USPC ..... 229/102, 132, 136; 206/807
See application file for complete search history.

(56) References Cited

U.S. PATENT DOCUMENTS 2,128,196 A * 8/1938 Vogel ..... 229/81
2,426,911 A 9/1947 Williamson
3,337,116 A 8/1967 Nowak
3,356,279 A 12/1967 Root
3,423,005 A * 1/1969 Leibson et al. ..... 229/228
3,568,911 A 3/1971 Bebout
3,788,876 A * 1/1974 Baker et al. ..... 229/132
3,843,037 A 10/1974 Susuki et al.
4,194,632 A 3/1980 Dutcher
4,479,588 A * 10/1984 Davis et al. ..... 229/102
4,508,226 A * 4/1985 Davis et al. ..... 229/102
4,566,627 A * 1/1986 Gendron ..... 206/807
4,646,960 A 3/1987 Challand
4,718,553 A 1/1988 Adamoli et al.
4,746,052 A * 5/1988 Schmissrauter ..... 229/102
4,746,061 A * 5/1988 Arvanigian ..... 229/102

(Continued)

FOREIGN PATENT DOCUMENTS

DE 4212323 A1 10/1993
DE 20302162 A1 6/2004

(Continued)

OTHER PUBLICATIONS

International Search Report mailed Jan. 5, 2012 for corresponding Application No. PCT/SE2011/051232.

(Continued)

*Primary Examiner* — Gary Elkins
(74) *Attorney, Agent, or Firm* — Karen G. Horowitz

(57) ABSTRACT

A box enclosing a chamber for carrying at least one object, such as a quantity of objects, is provided. The box comprises at least one wall, wherein said wall comprises a pair of overlapping flaps. The outer flap of said pair is adhesively attached to the inner flap of said pair to prevent access to the object(s) within the box. The outer flap is also arranged to release fragments without providing access to said objects if being tampered with.

21 Claims, 3 Drawing Sheets

(56) References Cited

U.S. PATENT DOCUMENTS

| | | | | |
|---|---|---|---|---|
| 4,945,708 | A | 8/1990 | Curiel | |
| 5,042,653 | A * | 8/1991 | Ems | 206/807 |
| 6,983,875 | B2 * | 1/2006 | Emmott | 229/313 |
| 8,020,751 | B1 * | 9/2011 | Emmott | 229/313 |
| 2003/0085265 | A1 | 5/2003 | Haim | |
| 2003/0098344 | A1 | 5/2003 | Blake | |
| 2005/0029336 | A1 | 2/2005 | Wende | |
| 2005/0103654 | A1 | 5/2005 | Hennessy | |
| 2005/0145683 | A1 * | 7/2005 | Alagna et al. | 229/102 |
| 2006/0131205 | A1 | 6/2006 | Sandberg et al. | |
| 2006/0289328 | A1 | 12/2006 | Hession | |
| 2008/0245698 | A1 | 10/2008 | Young | |
| 2009/0107873 | A1 | 4/2009 | Cotton et al. | |
| 2011/0162330 | A1 | 7/2011 | Cotton et al. | |
| 2011/0180432 | A1 | 7/2011 | Blick et al. | |
| 2012/0097736 | A1 | 4/2012 | Hultberg et al. | |

FOREIGN PATENT DOCUMENTS

| | | | |
|---|---|---|---|
| EP | 2192046 | B1 | 6/2010 |
| WO | WO 2006/079192 | A1 | 8/2006 |
| WO | WO 2006/131830 | A1 | 12/2006 |
| WO | WO 2008/054305 | A1 | 5/2008 |
| WO | WO 2008/062304 | A1 | 5/2008 |
| WO | WO 2008/086272 | A1 | 7/2008 |
| WO | WO 2008/091544 | A1 | 7/2008 |

OTHER PUBLICATIONS

International Search Report mailed Feb. 3, 2012 for corresponding Application No. PCT/SE2011/051233.

* cited by examiner

CHILD RESISTANT BOX FOR OBJECTS

FIELD OF THE INVENTION

The present invention pertains, in general, to the field of packets, and specifically to a package. More particularly, the present invention pertains to a box, which may be tampered with in an attempt to open the box without providing access to the contents of the box.

BACKGROUND OF THE INVENTION

Packages, such as boxes, have been proposed heretofore for carrying and dispensing articles such as individual objects from a quantity of objects, such as chewing gums, one at a time through an opening in the packet. Such packages are typically carried along by the consumer to have said objects at hand.

At home, such boxes are often found in readily accessible locations, such as on table tops. However, this may regarded as a safety risk for children, as they may get access to the box and thus also to the objects within the box. Thus, there is a need for packages which are childproof or at least child resistant and which may withstand tampering for some time without providing access to the objects within the box.

While there are examples of childproof or child resistant boxes within the art, such as the one disclosed in WO 08/054,305, the design of such boxes is only concerned with preventing children from getting access to the content of the box via the route intended to provide authorized access. Thus, alternative routes, which may be used to access the content in such boxes, are not addressed.

However, such packaging as currently exists in the prior art is generally concerned with the problem of providing evidence of tampering rather than preventing children from opening the packaging. Accordingly, such packaging may be opened easily and access to the content gained via other routes than the intended one.

Packages intended for pharmaceuticals, which are to be childproof, are typically plastic and glass jars/cans with a lid or cap requiring special handling to be opened. Further, the content may only be accessed via the opening covered by the lid.

Pharmaceuticals are also packaged in carton boxes. However, many such boxes are not childproof or child resistant and do thus require to be locked in upon storage in households with children.

While carton boxes are suitable to be brought along, such as in a jacket pocket, childproof plastic and glass jars/cans are typically not as readily portable as they are too bulky.

Accordingly, there is as a need for a childproof or child resistant packaging intended for pharmaceuticals, which is not unduly bulky and which is readily portable.

SUMMARY OF THE INVENTION

Accordingly, the present invention preferably seeks to mitigate, alleviate, eliminate, or circumvent one or more of the above-identified deficiencies in the art and disadvantages singly or in any combination, and solves at least the above mentioned problems by providing a box enclosing a chamber for carrying an article or articles, such as a quantity of objects. In one embodiment, a box formed according to the present invention comprises at least one wall, the wall comprising a pair of overlapping flaps, the flaps extending from separate other walls; the outer flap of the pair being adhesively attached to the inner flap of the pair to prevent access to the objects within the box; and the outer flap being arranged to release fragments from itself without providing accesses to the objects within the box if the box is being tampered with.

According to one aspect of the invention, a box is provided which prevents or at least severely delays unauthorized access to objects contained therein. Such delay preferably is significant enough so that a child loses patience and interest, and changes box-opening tactics and thereby is effectively prevented from opening the box.

Further advantageous features of the invention are defined in the dependent claims and with regard to embodiments disclosed herein.

BRIEF DESCRIPTION OF THE DRAWINGS

These and other aspects, features and advantages of which the invention is capable will be apparent and elucidated from the following description of embodiments of the present invention, reference being made to the accompanying drawings, in which.

DETAILED DESCRIPTION

The following description focuses on an embodiment of the present invention applicable to a box to render the box childproof or at least child resistant. The box may be used, for example, for carrying and dispensing objects, such as chewing gums, lozenges, tablets, sweets etc., and, in particular, objects containing ingredients that should not be ingested by children, such as chewing gums comprising nicotine. However, it will be appreciated that the invention is not limited to this application, but may be applied to many other dispensing boxes without departing from the scope of the present invention, such as for example boxes for carrying and dispensing lozenges, tablets, sweets, etc.

Figure 1:
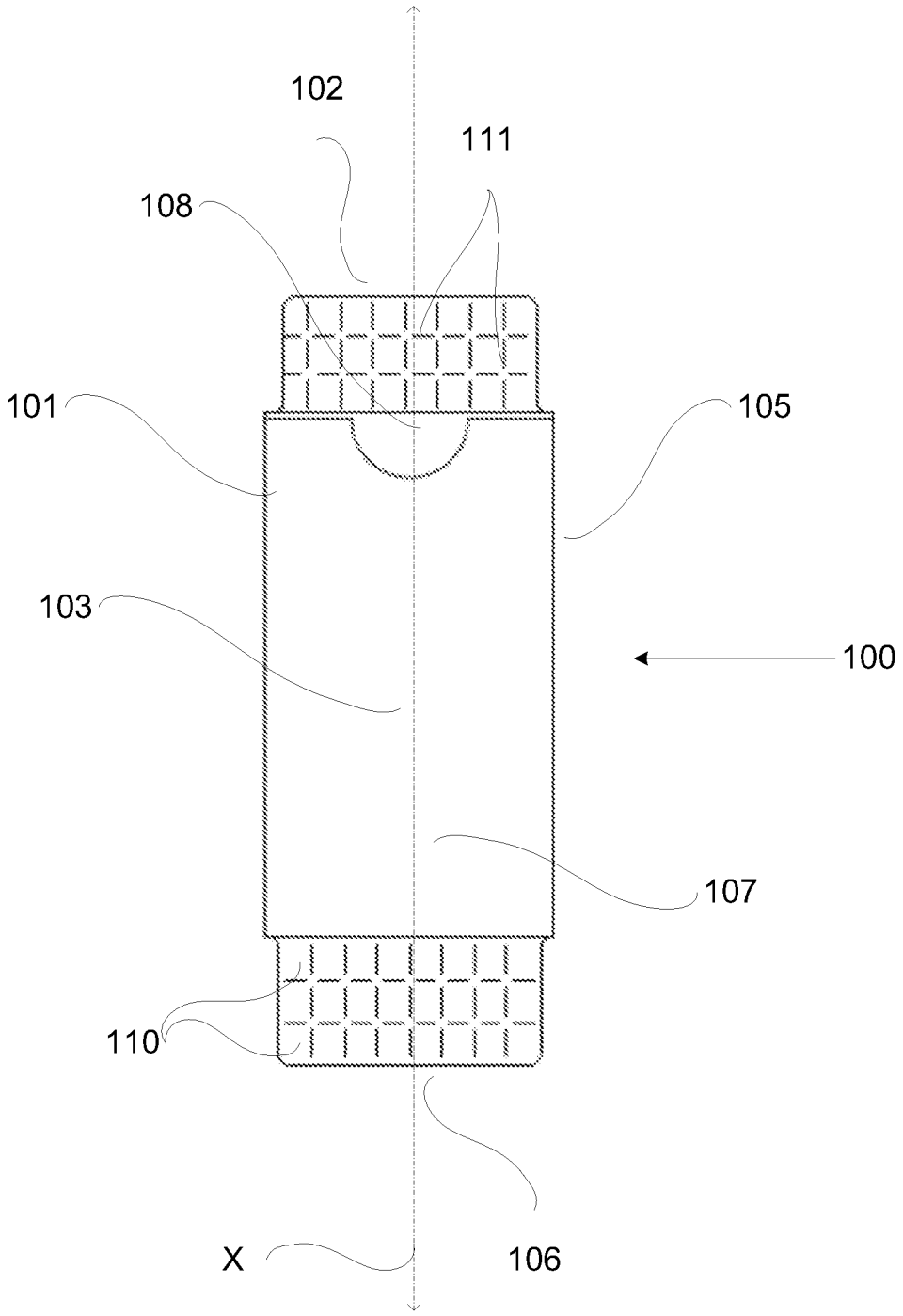
FIG. 1 is a front view of a box according to one embodiment of the present invention, with the end walls in an unfolded condition.
Figure 2:
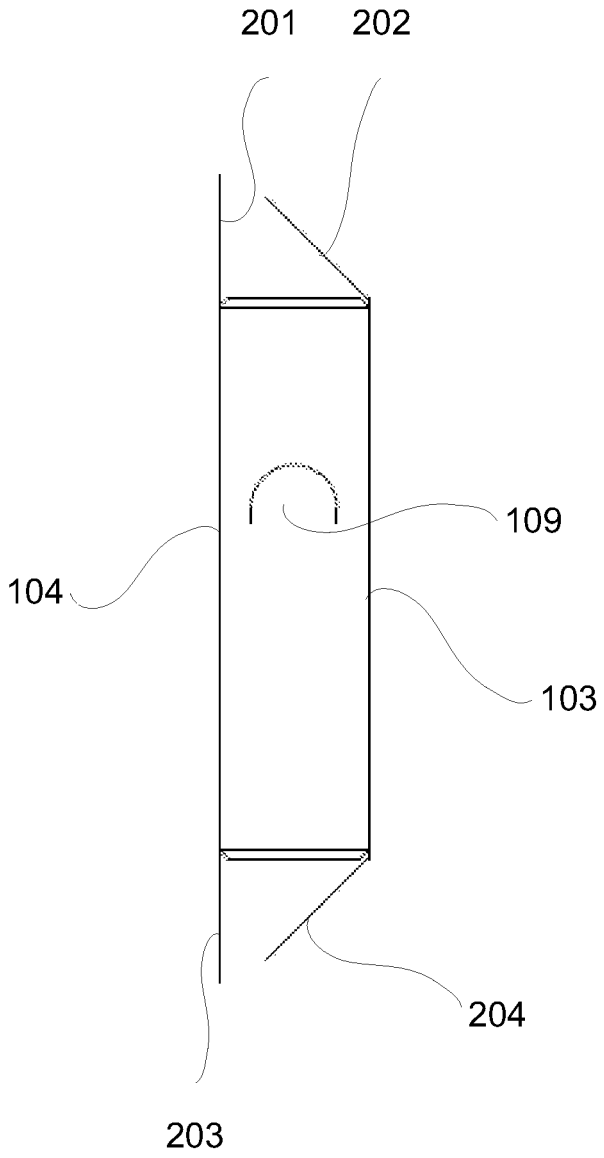
FIG. 2 is a side view of a box according to one embodiment of the present invention, with the end walls in an unfolded condition.
Figure 3:
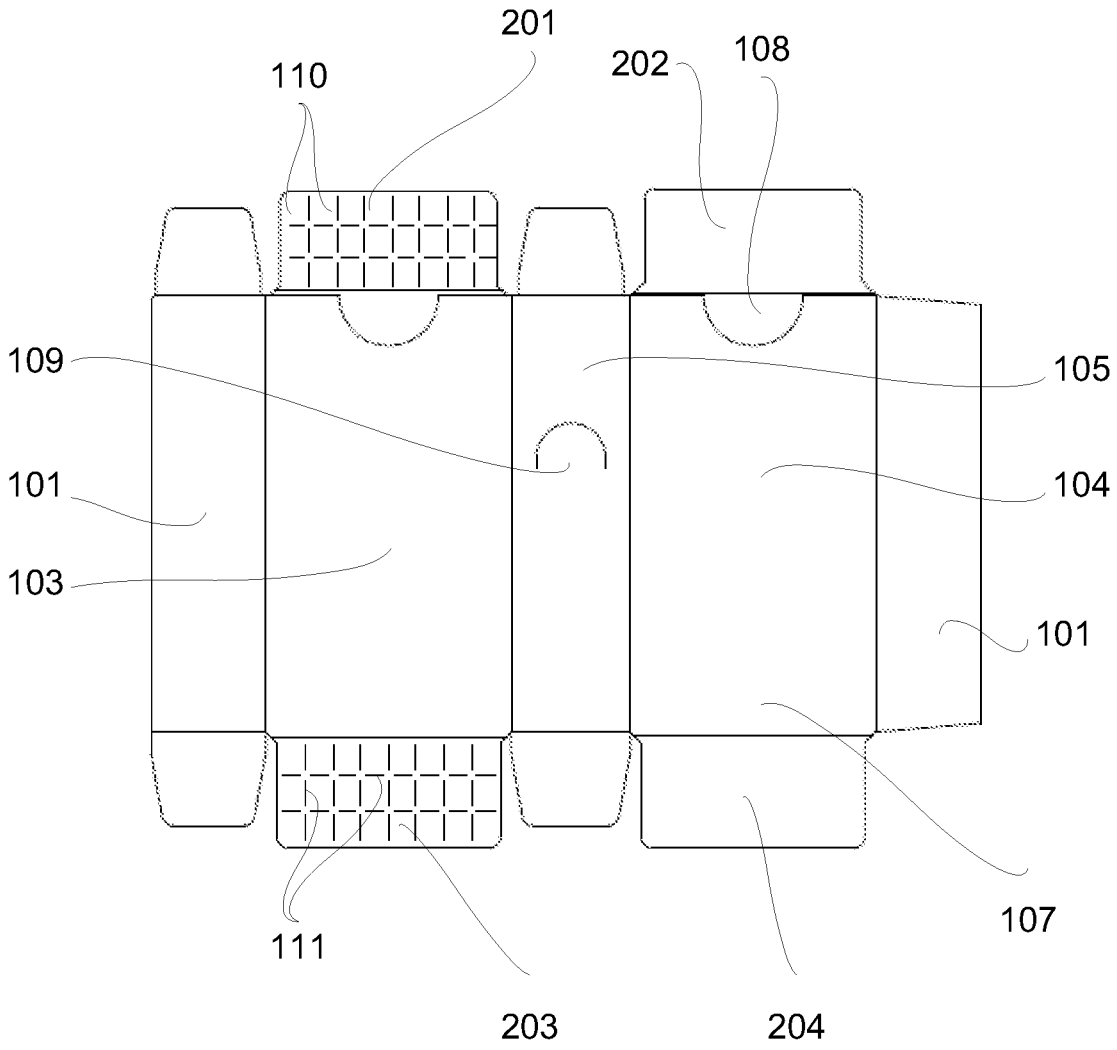
FIG. 3 is a view of a box blank according to one embodiment of the present invention.

According to a first embodiment, according to FIGS. 1 to 3, a box 100 for carrying one or more objects, such as a quantity of objects, is provided. As box 100 typically is manufactured by folding a blank, box 100 is typically formed from a foldable material, such as carton, paper, polymers (such as polymers based on dimethyl-2,6-naphtalene dicarboxylic or 2,6-naphtalene dicarboxylic acid monomers, such as polyethylene naphtalate (PEN) or polytrimethylene naphtalate (PTN), a copolymer of acrylonitrile and methacrylate (sold under the trade name Barex® by B.P.-Sohio), or a liquid crystal polymer), or any combination of these materials. When box 100 is a carton, paper, laminate, or cardboard box, the manufacturing costs may be kept low, while simultaneously keeping a satisfactory strength for multi-packaging of multiple boxes. When box 100 is a box of polymers, such as polymers based on dimethyl-2,6-naphtalene dicarboxylic or 2,6-naphtalene dicarboxylic acid monomers, such as polyethylene naphtalate (PEN) or polytrimethylene naphtalate (PTN), a copolymer of acrylonitrile and methacrylate (sold under the trade name Barex® by B.P.-Sohio), the reaction between the box and the contents thereof (e.g., nicotine) may be minimized.

The walls of the box may also be a laminate of at least two sheets each of which is of a material selected from the group consisting of carton, paper, polymers (such as polymers based on dimethyl-2,6-naphtalene dicarboxylic or 2,6-naphtalene dicarboxylic acid monomers, such as polyethylene naphtalate (PEN) or polytrimethylene naphtalate (PTN), a copolymer of acrylonitrile and methacrylate (sold under the trade name Barex® by B.P.-Sohio), or a liquid crystal polymer), or any combination of these materials.

The inner side of the walls may be coated with a material suitable for keeping the interior of the box moist and oxygen tight. A suitable material for coating the inner side of the walls of the box is a metal foil, such as aluminium foil.

Further, such a box may typically be obtained by folding a blank and adhesively attaching overlapping flaps, hinged to edges of the walls, to each other, as is well known to one skilled in the art.

Exemplary box 100, illustrated in FIG. 1 with its end walls unfolded, is a right-angled six-sided box with a front wall 103, a back wall 104, side-walls 101, 105 connecting opposing edges of said front wall and said back wall, and end walls 102, 106 between said side walls 101, 105 and said front wall 103 and back wall 104, respectively. The walls of box 100 enclose a chamber for carrying objects such as objects.

When box 100 is a six-sided, right-angled box according to the exemplary embodiment illustrated in FIGS. 1 to 3, packaging and transportation of multiple boxes is improved, since six-sided, right-angled boxes are volume effective in multi-packaging. Further, the attachment of overlapping flaps, hinged to edges of the walls of the box, to each other is improved if the wall to which the flaps are attached is planar. However, the shape of the box and the number of walls constituting the limits of the box may differ. In this respect the number of walls may be 2, 3, 4, 5 etc., whereby the walls are not necessarily planar, and the angles between the walls are not necessarily right-angled, as long as the walls define a chamber, according to the above description, for carrying at least one object, such as a quantity of objects, and also allow for overlapping flaps, being hinged to edges of box walls to be adhesively attached to each other.

One or more of the walls of a box formed by folding of package blank is typically formed from two overlapping flaps 201, 202. The flaps may be attached, such as by adhesive, to each other. Typically at least one of the end walls 102, 106 and one of the side walls 101 are formed by two overlapping flaps 201, 202, while the other side wall 105, the front wall 103, and the back wall 104 is a single layer of the package blank.

While the walls, which may be single layers of the package blank, typically are tamperproof, the outer flap in the walls formed by overlapping flaps, such as the wall formed by overlapping flaps 201, 202, may be separated from the inner flap, although being adhesively attached to each other. By arranging the outer flap such that fragments 110 are released therefrom, if attempts to separate the outer flap 201 from the inner flap 202 are made, access to objects present within the box may be prevented or at least delayed, as a major part of the outer flap has to be removed piece-by-piece in order to get access to the objects within the box. This is of great benefit for preventing children from getting access to objects contained in the box, such as when such objects comprise nicotine or other pharmaceutical substances, since children most often lack persistence in manipulating the same part of a box for an extended period of time to get access to the contents of the box. Thus, tampering for a longer period of time without resulting in access to the objects within the box may be achieved.

Accordingly, in the above-disclosed box, at least one of the end walls 102, 106 or at least one of the side walls 101, 105 may be formed from a pair of overlapping flaps, extending from separate walls. The outer flap 201, 203 may be adhesively attached to the corresponding inner flap 202, 204. Thus, access to the object(s) within the box is prevented or at least impeded significantly. In order to completely prevent or at least delay unauthorized access to the objects within the box, the outer flap is arranged to release fragments if being tampered with. In other words, tampering with the outer flap (to release it from the inner flap to access the contents of box 100) results in gradual fragmentation of the outer flap so that the outer flap cannot readily be removed from the inner flap as a single piece. The individual trying to access the contents of box 100 must persistently continue to tear away fragment after fragment in order to separate the outer flap completely from the inner flap, thereby to access the contents of box 100.

As both of end walls 102, 106 may be tampered with, it is preferred that both comprise such pairs of overlapping flaps 201, 202, 203, 204, and that the outer flap 201, 203 in both walls are arranged to release fragments if being tampered with.

Although side walls 101, 105 typically are longer than end walls 102, 106 and thus less prone to tampering, as the outer flap 201, 203 is more difficult to separate from the inner flap 202, 204, it is nonetheless preferable if one of side walls 101, 105 comprises such a pair of overlapping flaps and that the outer flap 201, 203 is arranged to release fragments 110 if being tampered with.

The outer flap 201, 203 may be arranged in different ways so that it may release fragments if being tampered with. Such arrangements may be used individually or may be combined in order to achieve synergistic effects.

According to one embodiment, such as the embodiment illustrated in FIGS. 1 to 3, outer flap 201, 203 of end walls 102, 106 is provided with a grid structure formed of intersecting weakening lines 111. Weakening lines 111 may be arranged as two sets of parallel weakening lines 111, said sets being perpendicular to each other. In between weakening lines 111, and as a result of tearing along weakening lines 111, fragments 110 are obtained. Outer flap 201, 203 thus has at least two weakening lines 111, which cross each other at least at one point. Weakening lines 111 may be notch lines or perforation lines. A notch line is, in this context, intended to be interpreted as a line of a continuous or discontinuous notch, where a notch does not pass through the whole thickness of the material, but only through a part of the thickness of the material, while a perforation line, in this context, is intended to be interpreted as a line of perforation(s), where a perforation passes through the whole thickness of the material. By having groups of parallel weakening lines 111, wherein the lines may extend from one edge of the flap to another, the lines will divide the flaps into regions, i.e., fragments 110. Upon tampering, rupture of the flap will be caused, whereby one region/fragment 110 at a time will be released, thus preventing or at least prolonging the time for access to the content of the box. As outer flap 201, 203 is adhesively attached to corresponding inner flap 202, 204, attempts to separate outer flap 201, 203 from inner flap 202, 204 will cause outer flap 201, 203 to rupture at weakening line 111, whereby a fragment or several fragments 110 is/are released. Further, the presence of two weakening lines 111, which cross each other at least at one point, will provide the flap with a weakening point. The presence of two weakening lines 111 crossing each other, and thus also providing a weakening point, will imply that the outer flap may release a fragment 110 and not just be ruptured if tampered with. Further and importantly, the flap will typically start to rupture at the crossing point, i.e., the weakening point, or at the edge of the flap if at least one of weakening lines 111 extends to or is close to the edge of the flap.

When weakening line 111 is a perforation line a sequential rupture of the weakening line 111 along itself may be assured, since parts of the weakening line 111 are already broken, whereby the release of fragments 110 may be improved.

By having at least three (3), such as at least five (5), at least ten (10), or even at least twenty (20), weakening lines 111, wherein each of the lines crosses at least one of the other lines at least at one point, the number of fragments 110 which may be released may be increased.

Such weakening lines may, independent of each other, be straight lines, curved lines or lines comprising straight linear parts, which are at an angle with respect to each other, such as L-shaped, U-shaped, or zigzag lines. Straight lines or lines comprising straight linear parts may be easier to achieve by punching.

At least one end of the weakening lines as disclosed herein may extend to an edge of said flap or at least in a proximity to the edge. Thereby rupture is typically initiated at the edge upon tampering.

In addition, or as an alternative to notch lines or perforation lines, only portions of the outer flap may be adhesively attached to the inner flap, thus permitting fragments to be formed by non-adhered portions between the inner flap and the outer flap upon tearing along select weakening lines. These non-adhered portions may be arranged in a set of parallel lines, in comparison with one of the sets of lines in the embodiment according to FIGS. 1 to 3. It is also possible to arrange non-adhered portions as a grid structure, in line with the embodiment disclosed in FIGS. 1 to 3, by arranging two parallel lines, wherein the two sets are perpendicular to each other. Thereby, rupture may occur at the borderline of attached and non-attached portions of the outer flap. Accordingly, fragments of the flap may be released upon tampering. Typically, the outer flap is adhesively attached to the inner flap by use of a suitable adhesive. The attached portions may correspond to regions of the flap separated by the notch lines or perforation lines. Further, it may be sufficient if only portions of such regions are attached. However, it is preferred if a major part, such as at least 75%, of such a region is attached.

Further, as an alternative or in addition to notch lines or perforation lines, and/or only partly attaching the outer flap to the inner flap, the outer flap may have a laminated structure. At least portions of the innermost layer of the laminate may be securely attached to the inner flap. Thereby, outer layer(s) of the laminate or fragments of the outer layer(s) of the laminate may be ripped off without removing the entire flap.

As the laminate comprises several layers, more fragments (layered together) have to be ripped off before the entire flap may be removed.

A box, as disclosed herein, may be used for carrying and dispensing objects, such as objects (chewing gums, lozenges, tablets, etc.). It is preferred that box 100 has child resistant opening means to allow for child resistant dispensing of objects from within box 100. Box 100 may be a package for solid or semi-solid pharmaceutical dosage forms comprising one or more substances for treating tobacco dependence. The substance for treating tobacco dependence may be nicotine. Thus, in one specific embodiment box 100 is a package for chewing gums comprising nicotine.

A box formed in accordance with the above-described principles of the present invention may further comprise at least one outer casing 107, and at least one inner casing 108, telescopingly arranged within outer casing 107, such as disclosed in published patent applications WO 2006/131830 and WO 2008/062304, hereby incorporated by reference herein in their entireties. The inner casing may then be provided with an opening on the side or front wall of box 100. Inner casing 108 is accommodated slidably within outer casing 107, capable of movement thus between a first closed configuration and a second open configuration. In the closed configuration, inner casing 108 is retracted and outer casing 107 located over the opening (not shown), concealing it completely, as illustrated in FIGS. 1 to 3, thereby closing box 100 and enclosing the object(s) contained therein. In the open configuration, inner casing 108 is extended a certain distance from outer casing 107, with the opening exposed at least in part. Outer casing 107 will then be located over the opening.

In one embodiment, outer casing 107 appears as a right parallelepiped with a rectangular base, presenting a bottom of box 100, and a side wall made up of four faces. Outer casing 107 presents an open end opposite to the bottom of inner casing 108 and box 100, and serves to accommodate inner casing 108. Inner casing 108 appears likewise as a parallelepiped having a rectangular base, presenting a top of box 100, a side wall made up of four faces, and an open end opposite the rectangular base of box 100. An opening will preferably then be arranged on one of the four faces of the side wall of inner casing 108.

Inner casing 108 is telescopically inserted into outer casing 107 with its open end first, such that the base of inner casing 108 will form the top of box 100, (end wall 102) and the base of outer casing 107 will form the bottom of box 100, i.e., end wall 106. Preferably, inner casing 108 fits only part of the way into outer casing 107, even in the closed configuration, without reaching the bottom of outer casing 107. Inner and outer casings 108, 107 combine to delimit the chamber of box 100 serving to contain the product(s), and varying in volume as the mutually slidable casings are displaced relative to each other. The chamber containing the product(s) communicates with surrounding outside space by way of the opening in inner casing 108. Inner casing 108 slides along a longitudinal axis X of box 100 between the retracted condition, i.e., closed configuration, mentioned above, in accordance with the disclosure in FIG. 1.

In the closed configuration, the edge of the side wall of outer casing 107 defining the open end of outer casing 107 is substantially flush with the edge between the side wall and the base of inner casing 107. The opening will be breasted by a side wall of outer casing 107. In an open configuration, inner casing 108 is slid outwardly from outer casing 107, such that the opening in inner casing 108 is exposed above the edge of the side wall of outer casing 107 defining the open end of outer casing 107.

Stabilizing means are arranged interposed between inner casing 108 and outer casing 107, serving to stabilize the open and the closed configuration, respectively, such that the box will neither open accidentally when not in use, nor close accidentally while the contents are being dispensed. Such stabilizing means function by exploiting the pliable nature of the material from which they are fabricated, generally carton, paper, laminate, Barex, or plastic. In this instance, such means could therefore be described as flexible stabilizing means. More precisely, the stabilizing means comprise at least one connecting appendage hinged to the side wall of outer casing 107 and to the side wall of inner casing 108, which is breasted in sliding contact with the aforementioned side wall of outer casing 107. The appendage may, for example, be attached at one end to the edge defining the open end of inner casing 108, and on the other end to inner side of the side wall of outer casing 107. An exemplary stabilizing means is illustrated in published patent applications WO 2006/131830 and WO 2008/062304, incorporated, above, in the present application.

Several variants of boxes having child resistant opening means are known in the art. In FIG. 2, a lock member 109 is disclosed. Lock member 109 may be created by providing a raised edge protruding outwardly from the side wall of inner casing 108. In a closed configuration of box 100, i.e., when inner casing 108 is in a retracted position in outer casing 107, the raised edge of inner casing 108 engages a corresponding raised edge on the inside of the side wall of outer casing 107. When the raised edge on inner casing 108 is pushed inwardly, it will loose engagement with the raised edge on outer casing 107, whereby inner casing 108 will be outwardly slidable along longitudinal axis X, illustrated in FIG. 1. Pushing of the raised edge on inner casing 108 will be facilitated by marking the corresponding position on the outside of box 100. It will further be facilitated by a through slot in the side wall of outer casing 107 on said corresponding position, such that the slot substantially corresponds to the engagement position in at least one point on said slot. Preferably said slot is curved, whereby the pushing is further facilitated since it will be possible to push the raised edge on inner casing 108 further inwardly without simultaneous movement of outer casing 107 in the same direction.

Although the present invention has been described above with reference to specific embodiments, it is not intended to be limited to the specific form set forth herein. Rather, the invention is limited only by the accompanying claims and, other embodiments than the specific above are equally possible within the scope of these appended claims. Various additions, modifications, and substitutions may be made therein without departing from the spirit and scope of the present invention. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention.

In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

What is claimed is:

1. A package for carrying at least one object, said package comprising at least one wall, wherein:

said at least one wall comprises at least one pair of overlapping flaps wherein said pair of overlapping flaps comprises an outer flap and an inner flap;

said outer flap of said pair of overlapping flaps is adhesively attached to said inner flap of said pair of overlapping flaps to prevent access to said at least one object within said package; and wherein said outer flap or each of said outer flaps has at least three weakening lines, wherein at least one of said weakening lines cross at least one of the other lines at least one point and said at least three weakening lines extend from one edge of said flap to another such to cause said outer flap to release fragments upon separation of said outer flap from said inner flap such that said fragments of said outer flap must be removed in order to access the at least one object in said package.

2. The package according to claim 1, wherein:

said package further comprises end walls, side walls, a front wall, and a back wall enclosing a chamber for carrying said at least one object; and at least one of said end walls or side walls comprises said pair of overlapping flaps.

3. The package according to claim 2, wherein said box is a right angled six-sided box with a front wall, a back wall, side walls connecting opposite edges of said front wall and said back wall, and end walls between said side walls and said front wall and back wall, respectively.

4. The package according to any of claim 2, wherein:

both said end walls comprise a pair of overlapping flaps, said flaps, in each pair of overlapping flaps, extending from separate walls;

the outer flap of each said pair is adhesively attached to the inner flap of each said pair to prevent access to said at least one object in said package.

5. The package according to claim 2, wherein:

at least one of said side walls comprises said at least one pair of overlapping flaps, said flaps, in each pair of overlapping flaps, extending from separate walls;

the outer flap of each said pair is adhesively attached to the inner flap of each said pair to prevent access to said at least one object in said package.

6. The package according to claim 1, wherein said package is manufactured from a material selected from the group consisting of carton, paper, polymers, such as polymers based on dimethyl-2,6-naphtalene dicarboxylic or 2,6-naphtalene dicarboxylic acid monomers, such as polyethylene naphtalate (PEN) or polytrimethylene naphtalate (PTN), a copolymer of acrylonitrile and methacrylate (sold under the trade name Barex® by B.P.-Sohio), a liquid crystal polymer, and any combination therof.

7. The package according to claim 6, wherein said package is manufactured from a laminate of at least two sheets each of which is formed of a material selected from the group consisting of carton, paper, polymers, such as polymers based on dimethyl-2,6-naphtalene dicarboxylic or 2,6-naphtalene dicarboxylic acid monomers, such as polyethylene naphtalate (PEN) or polytrimethylene naphtalate (PTN), a copolymer of acrylonitrile and methacrylate (sold under the trade name Barex® by B.P.-Sohio), a liquid crystal polymer, and any combination thereof.

8. The package according to claim 1, wherein said weakening lines are straight lines and wherein at least two weakening lines are parallel to one another.

9. The package according to claim 1, wherein said weakening lines are nonlinear.

10. The package according to claim 1, wherein only at least a portion of said outer flap is adhesively attached to said inner flap.

11. The package according to claim 1, wherein said outer flap has a laminated structure having an innermost layer securely attached to said inner flap, such that an outer layer of said laminate or fragments of said outer layer of said laminate may be ripped off without providing access to an object within said package.

12. The package according to claim 1, wherein said package is a package for solid or semi-solid pharmaceutical dosage forms comprising one or more substances for treating tobacco dependence.

13. The package according to claim 12, wherein said solid or semi-solid pharmaceutical dosage form is selected from the group consisting of chewing gums, lozenges, and tablets.

14. The package according to claim 12, wherein said substance for treating tobacco dependence is nicotine in any form.

15. A foldable blank, which blank may be folded to obtain a package according to claim 1.

16. The package according to claim 8, wherein said non-linear weakening lines are at least one of curved or a plurality of interconnected straight linear parts angled with respect to one another.

17. The package according to claim 7, wherein:

said at least one wall is a laminate of at least two sheets of material; and only at least a portion of said first sheet is adhesively attached to said second sheet.

18. The package according to claim 1, wherein said outer flap comprises at least five weakening lines.

19. The package according to claim 2, wherein said outer flap comprises at least five weakening lines.

20. The package according to claim 4, wherein said outer flap comprises at least five weakening lines.

21. The package according to claim 5, wherein said outer flap comprises at least five weakening lines.

* * * * *